United States Patent [19]

Elkin

[11] Patent Number: 4,463,950

[45] Date of Patent: Aug. 7, 1984

[54] BATTING PRACTICE TRAINER

[76] Inventor: Orville E. Elkin, P.O. Box 348, Winnsboro, La. 71295

[21] Appl. No.: 196,128

[22] Filed: Oct. 10, 1980

[51] Int. Cl.[3] ..... A63B 71/00

[52] U.S. Cl. ..... 273/26 R; 273/25

[58] Field of Search ..... 273/26 R, 25; 434/249, 434/250, 251

[56] References Cited

U.S. PATENT DOCUMENTS

| | | | |
|---|---|---|---|
| 3,466,039 | 9/1969 | Golomb | 273/25 |
| 3,703,285 | 11/1972 | Perry | 273/25 |
| 3,813,097 | 5/1974 | Darby | 273/25 |
| 3,889,379 | 6/1975 | Cline | 273/25 |
| 4,057,248 | 11/1977 | Stoecker | 273/26 R |
| 4,194,735 | 3/1980 | Wilson | 273/26 R |

*Primary Examiner*—Richard C. Pinkham

*Assistant Examiner*—T. Brown

*Attorney, Agent, or Firm*—Harvey B. Jacobson

[57] ABSTRACT

A batting practice trainer includes a baseball home plate having extended side edges which assist in defining the strike zone. The trainer is preferably of a molded integral vinyl or rubber construction and the extending side edges are colored fluorescent orange, while the home plate is white in color. The colored side edges serve to effectively define the strike zone in both the eyes of a batter and the pitcher, and at the same time, the edges assist a batter in determining where to stand relative to the home plate. The upper surfaces of the extending side edges are roughened and faceted to enhance light reflection. The lower surfaces of the extending side edges are roughened to increase friction so as to reduce displacement of the trainer in use.

4 Claims, 3 Drawing Figures

BATTING PRACTICE TRAINER

BACKGROUND OF THE INVENTION

1. Field of the Invention

The present invention relates to a batting practice trainer and more particularly pertains to a trainer which utilizes a home plate having extended colored side edges which assist in definng the strike zone.

2. Description of the Prior Art

There has been at least some attempts to construct baseball home plates in a manner which would assist a pitcher, as well as a batter, in defining the strike zone. For example, U.S. Pat. No. 1,432,293, issued to F. Ingols on Oct. 17, 1922, illustrates a baseball home plate which utilizes marked sights on the edges thereof. In this respect, the borders of the plate are provided with grooves extending parallel with a line between the pitcher's box and home plate, and white or conspicuously marked sights are adjustably held in these grooves and project above the plate. As such, in the event that the home plate per se shoud become covered with dirt or the like and thus not be completely visible to the pitcher or the batter, the sights will effectively define the edges of the plate. However, this construction is still not a totally satisfactory way of defining the strike zone, since the raised sights are themselves quite small and not all that visible from the pitcher's mound. Further, the marked sights cannot be used during a practice game but rather are limited to strictly batting practice, since the marked sights could cause serious injury to a player were he to step on one of the sights while running across home plate.

A different approach was taken in U.S. Pat. No. 3,341,199, issued to P. Madsen on Sept. 12, 1967, wherein a baseball home plate is disclosed which utilizes contrasting colors on the border portions of the plate. Primarily these colored markings on the borders of the plate are provided to assist an umpire in defining the strike zone and are not all that much of an assistance to the pitcher. Specifically, the colored portions of the plate are so small in size as to be nearly invisible to the pitcher and further, dirt and other debris will gradually accumulate over the colored portions so as to defeat their functional purpose. Additionally, neither the Madsen nor Ingols batting practice trainers serve to assist in positioning a batter relative to the home plate, but rather are useful only in defining the strike zone.

There has also been a number of attempts to develop batting practice trainers which assist in correctly positioning a batter relative to the home plate so as to effectively improve his batting practice stance and hitting ability. In this connection, U.S. Pat. No. 3,342,487, issued to D. David on Sept. 19, 1967, discloses a baseball stance and stride practice plate which envisions utilizing two sheets of plywood having various strips of wood nailed thereto, such strips serving to effectively position a batter's feet in a proper stance during batting. The sheets of plywood are optionally positional on either side of the home plate and are not designed to assist in defining the strike zone. Similarly, U.S. Pat. No. 3,813,097, issued to L. Darby on May 28, 1974, illustrates a batsman box surface made of hard automobile tire-like black rubber which is positionable about a home plate and which utilizes 24 stakes driven into the ground to hold the same in place. A batter stands upon the surface of the batsman box while batting and, as with the David device, no means is provided to assist in defining the strike zone. U.S. Pat. No. 3,815,906, issued to L. Hermo on June 11, 1974, and U.S. Pat. No. 3,979,116, issued to J. Matchick on Sept. 7, 1976, illustrate further batting practice trainers which are designed solely for the purpose of positioning a batter's feet relative to the home plate and which do not assist in defining a strike zone. In this respect, both of these trainers are constructed separately from a baseball home plate and may be optionally removed or used during practice.

SUMMARY OF THE INVENTION

The general purpose of the present invention, which will be described subsequently in greater detail, is to provide a batting practice trainer having all of the advantages of the prior art trainers and none of the disadvantages. To attain this, the present invention utilizes a white baseball home plate having extended side edges or borders which are preferably colored fluorescent orange. The entire trainer is of an integral molded vinyl or rubber construction, and the extended borders are provided with a faceted, roughened reflective surface so as to enhance the visibility thereof. The construction of the present invention thus serves to clearly define a strike zone, as seen by the umpire, batter and pitcher, and at the same time due to the width of the extended borders, serves to correctly position a batter relative to the home plate.

It is therefore an object of the present invention to provide a batting practice trainer which has all the advantages of the prior art trainers and none of the disadvantages.

It is another object of the present invention to provide a batting practice trainer which may be economically and easily manufactured.

It is a further object of the present invention to provide a batting practice trainer which clearly and effectively serves to define the strike zone.

Still another object of the present invention is to provide a batting practice trainer which may be utilized to correctly position a batter relative to the home plate.

Yet another object of the present invention is to provide a batting practice trainer which utilizes a roughened, colored reflective surface to define a strike zone.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
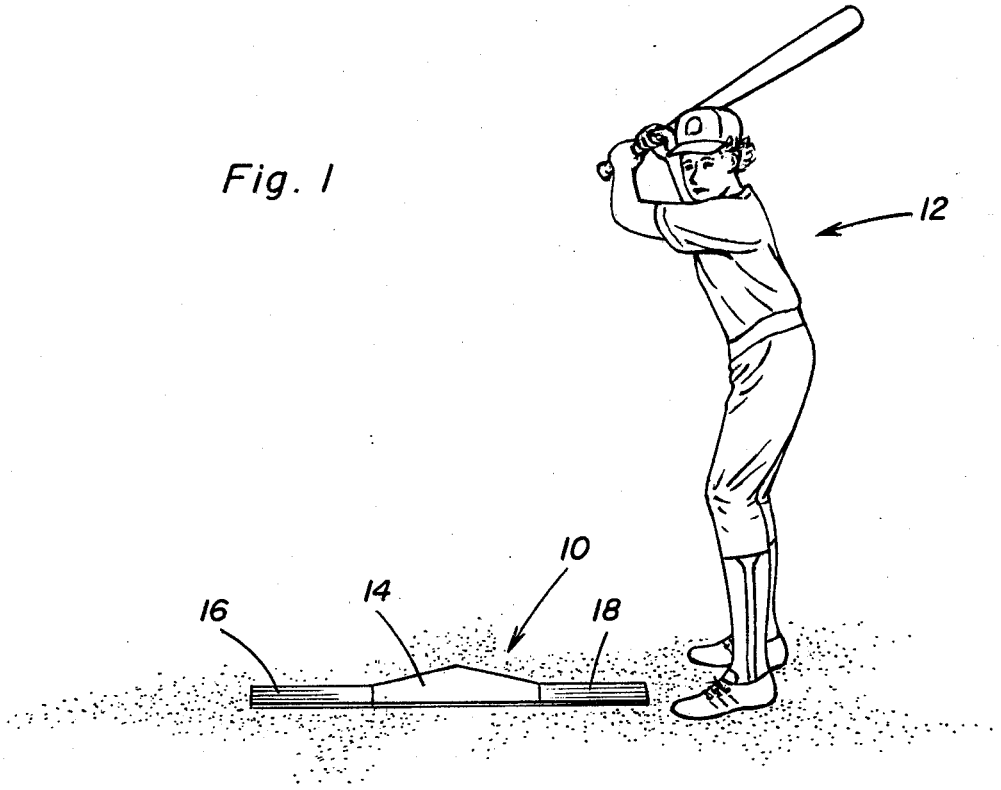
FIG. 1 is a perspective view of the present invention being utilized by a batter.

Referring to FIG. 1 of the drawings, the batting practice trainer forming the present invention and as generally designated by the reference numeral 10 is shown operably positioned on the ground and being utilized by a batter 12. In this respect, the trainer 10 includes a baseball home plate portion 14 having integral extended borders or side edges 16, 18 respectively. The trainer 10 is preferably molded from vinyl, rubber or other similar material, and further has the home plate portion 14 colored white, while the extended borders, 16, 18 are of a contrasting color, such as fluorescent orange or the like. As shown, the extended borders 16, 18 are of such a width as to cause a batter 12 to stand sufficiently far from the home plate portion 14 so as to be correctly positioned for the purpose of batting. In this connection, the extended borders 16, 18 are not designed to be stood on by the batter 12, but rather serve the dual function of positioning the batter while at the same time defining the strike zone over the home plate portion 14.

Figure 2:
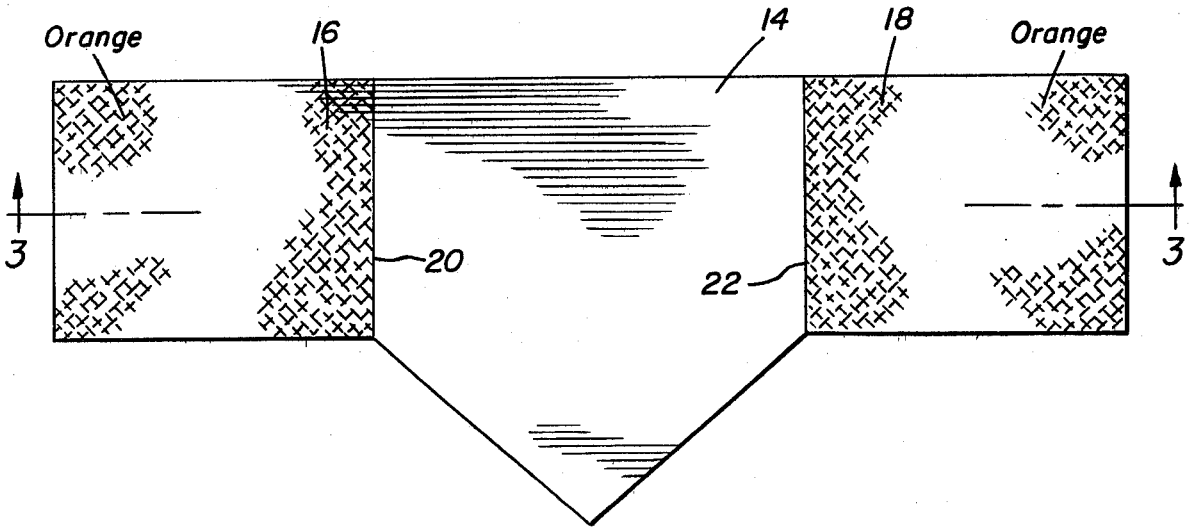
FIG. 2 is a top plan view of the batting practice trainer forming the present invention.

FIG. 2 more clearly illustrates the construction of the batting practice trainer 10. In this regard it will be noted that the extended borders 16, 18 lie proximate to the home plate portion 14 and are integrally joined thereto along the edges 20, 22 respectively. While an integral molded construction is the preferred means of manufacturing the batting practice trainer 10, it is to be understood that the extended borders 16, 18 could be separately manufactured and then fixedly secured to the home plate portion 14 by suitable fastening means, such as gluing or the like.

Further illustrated in FIG. 2 is the fact that the extended borders 16, 18 are provided with roughened, faceted upper surfaces so as to enhance the light reflective ability thereof. Additionally, the knurled effect provided on the extended borders 16, 18 assists in keeping the borders visible although a certain amount of dirt or other debris may accumuate thereon. If provided on both the upper and lower surfaces of the extended borders 16, 18, the roughened surface effect will additionally serve to securely, frictionally position the home plate portion 14 in a desired manner, i.e., the roughened borders 16, 18 will substantially reduce the amount of displacement of the home plate portion 14 as might be caused by players coming into contact therewith.

Figure 3:
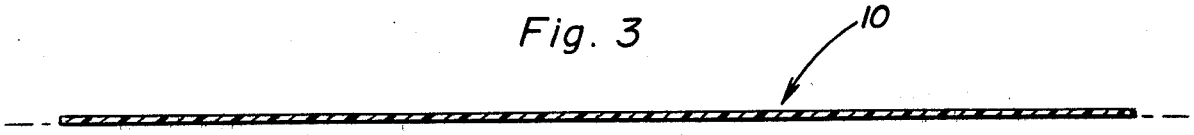
FIG. 3 is a longitudinal edge view taken along the line 3—3 of FIG. 2.

Lastly, FIG. 3 has been provided to illustrate the substantially flat and integral construction of the batting practice trainer 10. In this regard, it can be appreciated that the trainer 10 is of a lightweight construction which facilitates the easy placement and removal of the same during and after batting practice respectively.

In using the batting practice trainer 10 forming the present invention, it can be appreciated that the extended borders 16, 18, which may be of a fluorescent orange color, are clearly visible to a pitcher and as such serve to define the positioning of the home plate portion 14 regardless of the amount of dirt and other debris covering the same. Further, the extended borders 16, 18 assist both the batter and the umpire in locating the strike zone as defined by the home plate portion 14. Additionally and as clearly illustrated in both FIGS. 1 and 2 of the drawings, the extended borders 16, 18, are of such a width as to facilitate a correct positioning of a batter 12 relative to the home plate portion 14. In this connection, it is important that a batter 12 stand a certain distance from the home plate portion 14 during batting so as to insure the best chance of hitting a pitched ball. The extended borders 16, 18, which might typically be 13 inches wide, fulfill this need for correct positioning of a batter, since a batter need only to position his feet proximate to an outside edge of one or the other of the extended borders 16, 18 to be relatively sure that he is in a correct position.

As such, the batting practice trainer 10 forming the present invention serves the dual function of correctly positioning a batter during batting relative to the home plate as well as to facilitate the visibility of the strike zone. In this connection, the knurled faceted surfaces of the respective extended borders 16, 18 enhance the color reflection thereof in all directions, so that the umpire, batter and pitcher all are afforded high visibility regarding the positioning of the strike zone. While the batting practice trainer 10 has been illustrated and described in one preferred embodiment, it is to be understood that the optimum dimensional relationships for the parts of the invention are deemed readily apparent and obvious to one skilled in the art, and all equivalent relationships to those illustrated in the drawings and described in the specification are intended to be encompassed by the invention, subject only to limitations specifically appearing in the claims.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, following within the scope of the invention.

What is claimed as new is as follows:

1. A batting practice training, safety and educational apparatus comprising:

a baseball home plate constructed of a flat material for use during batting practice and educational training sessions and having a color indicia throughout for serving to assist the batter relative to the location of the batter's box and home plate and the lateral strike zone area thereof; and batter positioning means for said flat material extending contiguously on each side of the baseball home plate so constructed and arranged integrally therewith for defining limits of a strike zone portion and a batter positioning portion, the batter positioning means including contrasting color indicia throughout relative to the color indicia of the baseball home plate and having an upper roughened, faceted surface so as to enhance light reflection, the visibility together with the educational and training capability thereof.

2. The invention of claim 1 wherein the color indicia of the batter positioning means is fluorescent orange and that of the baseball home plate is generally white.

3. The invention of claim 1 wherein the upper roughened, faceted surface of the batter positioning means is knurled.

4. The invention of claim 1 wherein a lower surface of the batter positioning means is similarly roughened throughout to serve for securely and frictionally positioning the integrally constructed assembly in a given location and for substantially reducing the amount of displacement thereof during use in play.

* * * * *